US008839986B2

(12) United States Patent
Angert

(10) Patent No.: US 8,839,986 B2
(45) Date of Patent: Sep. 23, 2014

(54) INSERTABLE DISPOSAL DEVICE

(71) Applicant: Ofer Angert, Ranat Gan (IL)

(72) Inventor: Ofer Angert, Ranat Gan (IL)

( * ) Notice: Subject to any disclaimer, the term of this patent is extended or adjusted under 35 U.S.C. 154(b) by 0 days.

(21) Appl. No.: 13/682,744

(22) Filed: Nov. 21, 2012

(65) Prior Publication Data

US 2013/0126525 A1 May 23, 2013

(51) Int. Cl.

| | |
|---|---|
| ***B65D 43/08*** | (2006.01) |
| ***B65D 51/04*** | (2006.01) |
| ***B65D 43/04*** | (2006.01) |
| ***B65F 1/14*** | (2006.01) |
| ***B65F 1/00*** | (2006.01) |
| ***A47K 10/46*** | (2006.01) |
| ***B65F 1/12*** | (2006.01) |

(52) U.S. Cl.

CPC ... *B65F 1/00* (2013.01); *B65F 1/14* (2013.01); *A47K 10/46* (2013.01); *B65F 1/1646* (2013.01); *B65F 1/12* (2013.01); *Y10S 206/804* (2013.01)

USPC ..... 220/805; 220/4.26; 220/212; 220/810; 206/804

(58) Field of Classification Search

CPC ..... B65D 85/672; A47K 10/16; A47K 10/18; A47K 10/22; G09F 23/00; G09F 23/10; G09F 23/12; B65H 75/182

USPC ..... 220/4.26, 4.28, 212, 243, 244, 780, 220/810, 825, 833, 796, 805; 206/804, 805; 242/600, 610.1

See application file for complete search history.

(56) References Cited

U.S. PATENT DOCUMENTS

| | | | | |
|---|---|---|---|---|
| 1,844,285 | A * | 2/1932 | Johnson | 206/445 |
| 5,402,978 | A * | 4/1995 | Larson | 248/309.2 |
| 6,048,014 | A * | 4/2000 | Stefanik | 294/99.1 |
| 7,544,294 | B2 * | 6/2009 | Halterman | 210/232 |
| 2003/0006336 | A1 * | 1/2003 | Myers, Jr. | 242/600 |

FOREIGN PATENT DOCUMENTS

| | | | | |
|---|---|---|---|---|
| DE | 3619438 | A1 * | 6/1986 | B65D 85/672 |
| DE | 3619438 | A1 | 12/1987 | |
| RU | WO 2007/024156 | A1 * | 1/2007 | G09F 23/12 |

* cited by examiner

*Primary Examiner* — Steven A. Reynolds
*Assistant Examiner* — Javier A Pagan
(74) *Attorney, Agent, or Firm* — Patwrite Law; Mark David Torche

(57) ABSTRACT

A disposal device insertable into a paper roll is disclosed. The disposal device includes a cylindrical shell receptacle, a cap cover, and a clearing mechanism, adapted for removing objects from the receptacle. The clearing mechanism includes a lateral member, adapted to collect objects from the receptacle and a longitudinal member, implemented for conveying a physical force for the translation of the lateral member or serves as an actuator for the commencement of the translation.

13 Claims, 5 Drawing Sheets

INSERTABLE DISPOSAL DEVICE

CROSS REFERENCE TO RELATED APPLICATIONS

This application claims priority under the Paris Convention on Israeli Patent Application No. 216562 filed on Nov. 23, 2011, the entire content of which is herein incorporated by reference

TECHNICAL FIELD

In general, the present invention pertains to articles of household and kitchenware. In particular, the invention relates to a disposal device adapted to be used with paper rolls known in the art and a mechanism for clearing the interior thereof.

BACKGROUND OF THE INVENTION

It is believed that the pertinent state-of-the-art is represented by: German patents/applications Ser. No. DE3619438 and DE10312453 as well as by international patent application Pub. No. WO2007024156.

DE3619438 discloses a device for receiving flat disposable items, in particular handkerchiefs, flannels, hand towels, nappies or nappy pants, in particular made of cellulose or paper. The items form a long strip in which the individual items are connected to one another by perforations. The strip is rolled up onto a hollow inner roll. The hollow inner part can be closed at one or two ends by a lid. This forms the interior of the role as a container into which used handkerchiefs and other items such as patches can be introduced.

DE10312453 discloses a cardboard drum used for holding toilet tissues or kitchen towels. For an increase of sales or for use as a special promotion product the drum could be filled with an interesting object to be accessed after a plug or a cap has been removed from one end of the drum. The object can be related to the article like a pack of condoms accommodated in a toilet roll, a recipe in a kitchen roll, or of a general interest like sweets or a sample of a promoted item.

WO2007024156 discloses a long length article which is embodied in the form of a roll wound on a spool and is provided with a long length web and advertising and/or other effect elements, the spool is provided with non-authorized access limiters which are arranged on the end faces thereof and embodied in the form of lids, wherein the lids are positioned on the end faces of the spool and at least one lid has a large part embodied in the form of a flange and a narrow hollow part which forms the lid wall and is arranged in the spool internal part.

SUMMARY OF THE INVENTION

A disposal device insertable into a paper roll is disclosed. The disposal device includes a cylindrical shell receptacle, a cap cover, and a clearing mechanism, adapted for removing objects from the receptacle. The clearing mechanism includes a lateral member, adapted to collect objects from the receptacle and a longitudinal member, implemented for conveying a physical force for the translation of the lateral member or serves as an actuator for the commencement of the translation.

BRIEF DESCRIPTION OF THE DRAWINGS

The present invention will be understood and appreciated more comprehensively from the following detailed description taken in conjunction with the appended drawings in which.

Figure 1A:
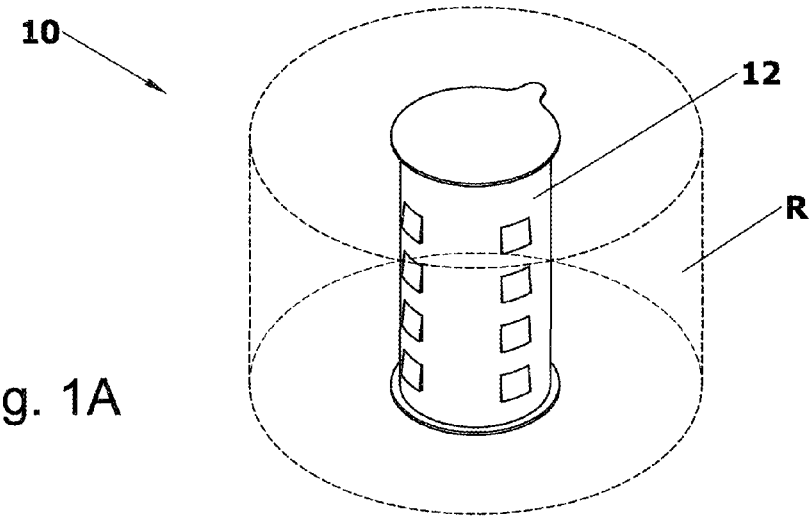
FIG. 1A is a schematic isometric view of an embodiment of the disposal device of the invention inserted into a paper roll, which is shown in dashed lines.
Figure 1B:
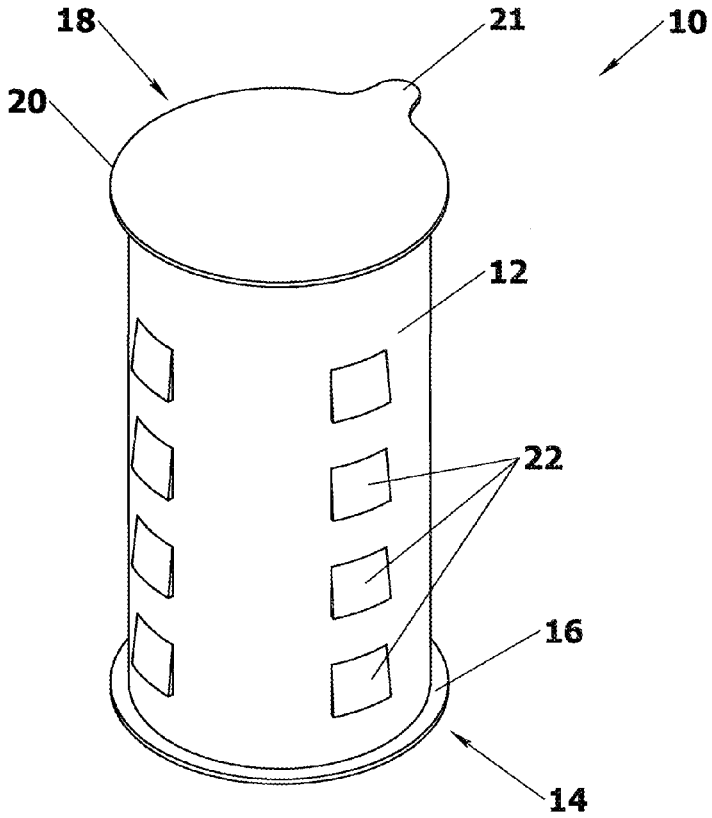
FIG. 1B is an enlarged view of the embodiment of the disposal device of the invention shown in FIG. 1A.
Figure 1C:
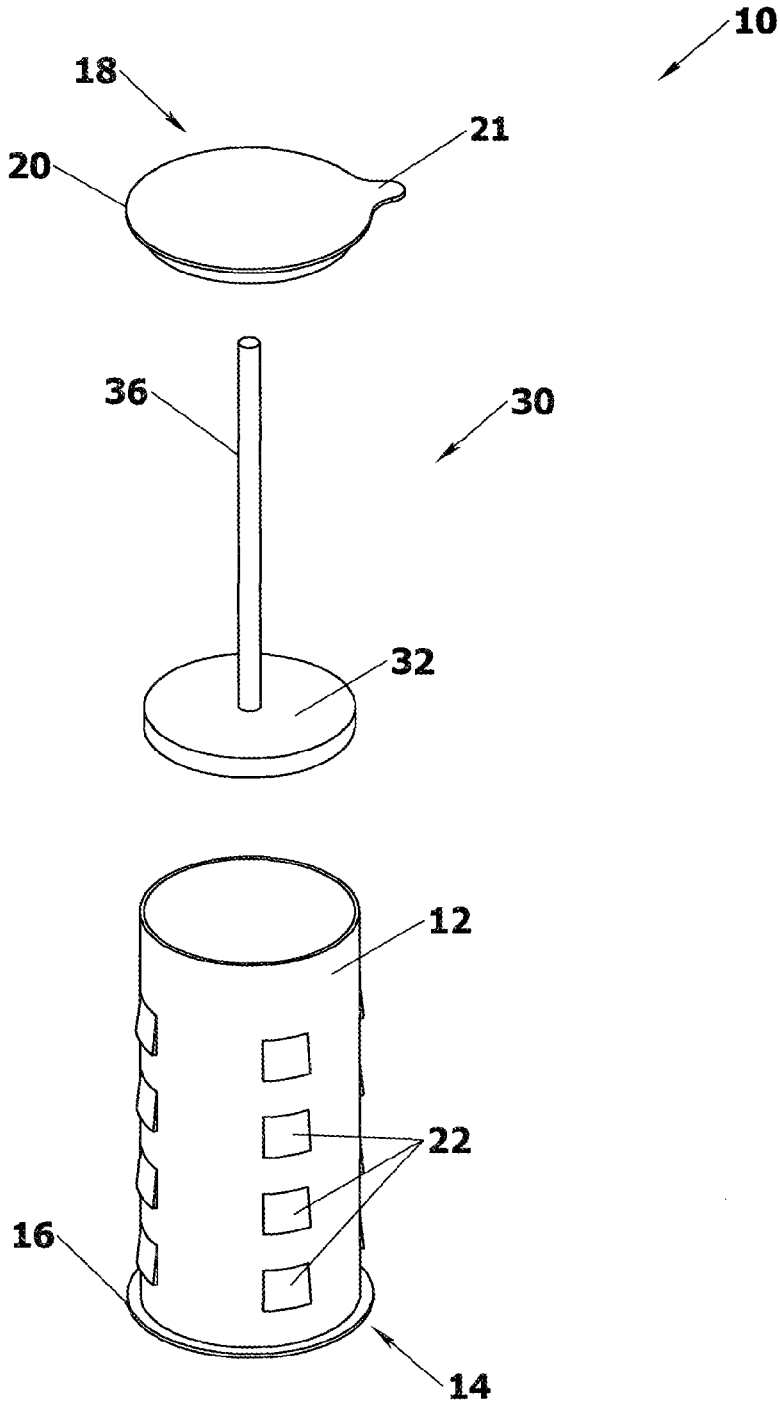
FIG. 1C is an exploded view of the embodiment of the disposal device of the invention shown in FIG. 1B.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

In accordance with some embodiments of the invention, reference is now made for FIG. 1A to 3B, showing insertable disposal device 10. Disposal device 10 is insertable into roll R, which is typically a toilet paper roll known in the art. Disposal device 10 comprises a cylindrical shell receptacle 12. Cylindrical shell receptacle 12 comprises an interior lumen, adapted to receive and contain various objects (not shown), in a non-limiting manner including a used toilet paper, wastage, etc.

Cylindrical shell receptacle 12 is furnished with bottom cover 14. Bottom cover 14 is either an integral portion of receptacle 12 or an individual modular part (not shown), adapted to be reversibly mounted/removed onto/from the bottom portion of receptacle 12. Bottom cover 14 is preferably provided with an exterior circumferential ridge extending outwardly from the exterior surface of receptacle 12, forming a flange-shaped element 16 at the bottom of receptacle 12.

The diameter of circumferential flange-shaped element 16 is typically somewhat larger than the diameter of the interior aperture in standard paper rolls known in the art, such as toilet paper rolls. Therefore upon introducing disposal device 10 into a paper roll, such as toilet paper roll R, flange-shaped element 16 acts as a mechanical stopper, preventing the introduction of disposal device 10 into a paper roll beyond flange-shaped element 16.

Disposal device 10 comprises cap cover 18. Cap cover 18 is either permanently connected (not shown) to receptacle 12 by a hinge or forms an individual modular part, adapted to be reversibly mounted/removed onto/from the top portion of receptacle 12. Cap cover 18 preferably comprises exterior circumferential ridge 20 extending outwardly from cap cover 18, forming a flange-shaped element at the top bottom of receptacle 12.

The diameter of circumferential flange-shaped element 20 is typically somewhat larger than the diameter of the interior aperture in standard paper rolls known in the art, such as toilet paper rolls. Therefore upon introducing disposal device 10 into a paper roll, such as toilet paper roll R, flange-shaped element 20 acts as a mechanical stopper, preventing the introduction of disposal device 10 into a paper roll beyond flange-shaped element 20.

Cap cover 18 is comprises tab portion 21, adapted for forcefully opening cover 18. Cap cover 18 and/or receptacle 12 are optionally include a latching elements (not shown), adapted to secure cover 18 in a closed conformation on top of receptacle 12.

Optionally the exterior surface of receptacle 12 is furnished with a plurality of detents 22. Detents 22 are aimed at preventing uncontrolled sliding of receptacle 12 in a paper roll, such as toilet paper roll R; thereby affixing disposal device 10 within the paper roll. Detents 22 typically prevent a unidirectional translation of disposal device 10 to the bottom of paper roll R; thereby locking-on roll R.

Disposal device 10 further comprises clearing mechanism 30 for removing the objects (not shown) from the interior lumen of receptacle 12. Clearing mechanism 30 comprises lateral member 32 and longitudinal member 36. Lateral member 32 is adapted to collect objects (not shown) across substantially the entire cross-section of receptacle 12. Longitudinal member 36 is implemented for conveying a physical force for translation of lateral member 32 or serves as an actuator translation of lateral member 32.

In merely exemplary manner, longitudinal member 36 embodies a plate shape, however any type of elements capable to collect objects (not shown) across substantially the entire cross-section of receptacle 12, including baskets, nets and gratings, which are considered similar technical solutions.

Figure 2C:
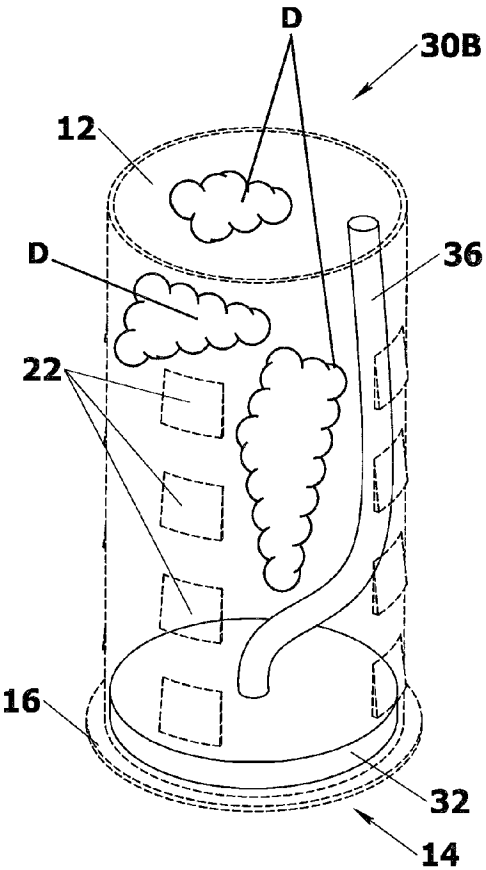
FIG. 2C is a schematic isometric view of the embodiment of the disposal device of the invention, shown in FIG. 2B, with the clearing mechanism in filled conformation, showing disposal objects D.
Figure 2B:
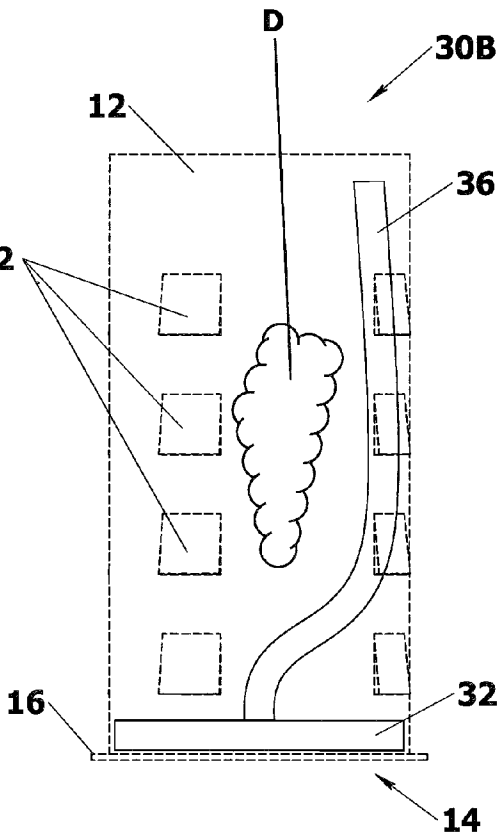
FIG. 2B is a schematic side view of the embodiment of the disposal device of the invention with the clearing mechanism in filled conformation, showing disposal object D.
Figure 2A:
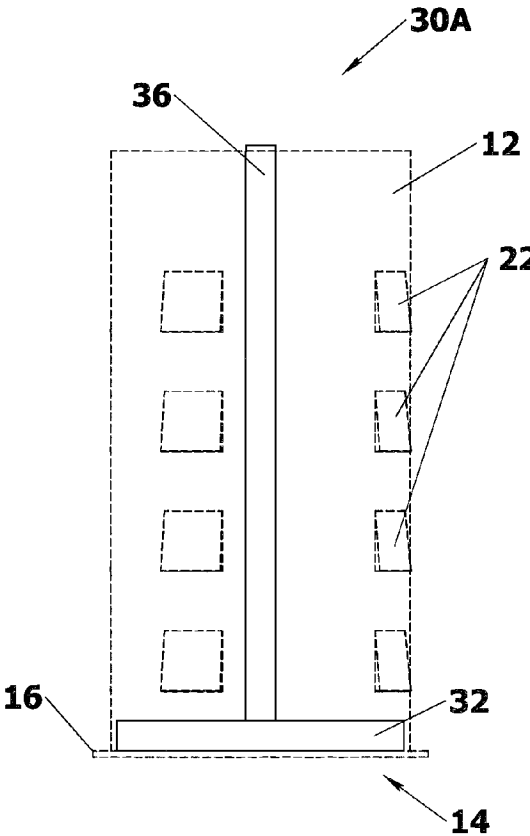
FIG. 2A is a schematic side view of the embodiment of the disposal device of the invention with the clearing mechanism in empty conformation.

Longitudinal member 36 embodies a rod shape. Longitudinal member 36 comprises a somewhat firm and resilient material. The resiliency of the material forming longitudinal member 36 allows member 36 to reversibly assume at least two conformations. While receptacle 12 is empty, longitudinal member 36 of clearing mechanism assumes an empty conformation 30A, wherein longitudinal member 36 erects up-straight from the centre of lateral member 32, essentially as shown in FIG. 2A. While receptacle 12 contains objects (not shown), longitudinal member 36 of clearing mechanism assumes a filled conformation 30B, wherein longitudinal member 36 is pushed sidewise towards the cylindrical wall of receptacle 12, essentially as shown in FIGS. 2B and 2C.

In some embodiments, longitudinal member is a strip (not shown) connected to lateral member 32 at the edge thereof. Two or more strip-like lateral members (not shown) may be circumferentially disposed along the edge of lateral member 32. A prominent benefit of strip-like lateral member/s (not shown) disposed at the edge of lateral member 32 is that there is no need to assume different conformations, since such a strip-like lateral member (not shown) extend from lateral member 32 about the cylindrical wall of receptacle 12, hence more firm lateral members are applicable.

In other embodiments, longitudinal member is a string (not shown) connected to lateral member 32. String-like longitudinal member (not shown) is capable of easily assuming insertable disposal device. In such embodiments, receptacle 12 and/or cap cover 18 is/are provided with at least one structural element, employed for affixing the terminal portion of string-like longitudinal member (not shown) at the top portion of disposal device 10.

In yet some preferred embodiments, an energy accumulating means is provided (not shown). The energy accumulating means (not shown), which can be implemented in a compressed and/or stretched member (not shown), accumulates mechanical energy upon translation of and/or exerting of force onto lateral member 32. Instances of compressed and/or stretched member of energy accumulating means in a non-limiting manner include springs and elastic bands. In such embodiments, disposal device 10 is optionally provided with a ratcheting mechanism, whereas longitudinal member is merely an actuator facilitating the release of the ratcheting mechanism. Consequently, upon introducing objects into receptacle 12, lateral member 32 is intermittently translated towards the bottom of disposal device 10 and the energy accumulating means (not shown) accumulates a mechanical energy; whereas upon affecting the longitudinal member, the ratcheting mechanism is released and the energy accumulating means facilitates a forceful translation of lateral member 32 towards the top of disposal device 10 and thereby effects a instant disposal of the objects found in receptacle 12.

Figure 3A:
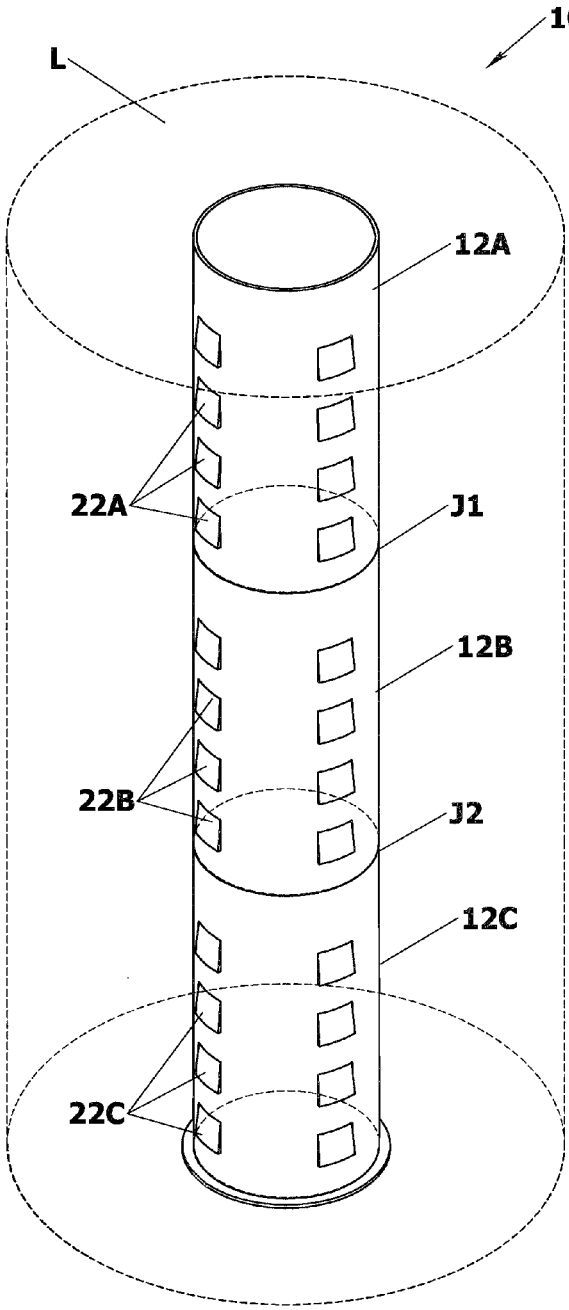
FIG. 3A is a schematic isometric view of another embodiment of the disposal device of the invention inserted into a long paper roll, which is shown in dashed lines.
Figure 3B:
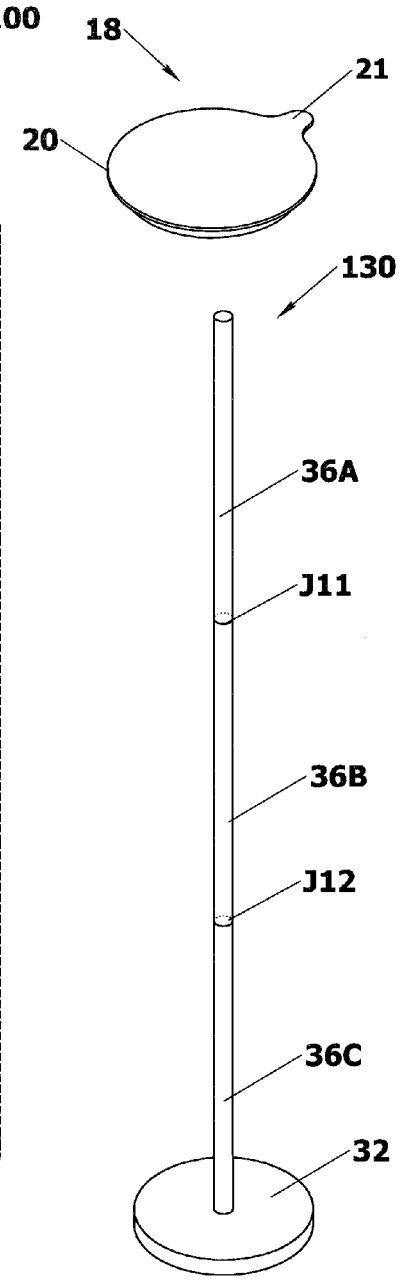
FIG. 3B is an isometric view of the clearing mechanism of the embodiment of the disposal device of the invention inserted shown in FIG. 3A.

In accordance with some embodiments of the invention, reference is now made for FIGS. 3A and 3B, showing insertable disposal device 100 and clearing mechanism thereof 130. Disposal device 100 is inserted into a long-roll L, which is typically a paper-towel roll known in the art. Disposal device 100 is characterized by concatenation of several cylindrical shell receptacles 12A to 12C. Receptacles 12A to 12C are concatenated longitudinally in tandem; so that the bottom of receptacles 12A and 12B are respectively connected to the top of receptacles 12B and 12C, at the corresponding joints J1 and J2. The types of connection between receptacles 12A and 12B as well as between receptacles 12B and 12C at respective joints J1 and J2 in a non-limiting manner include: screw threading, frictional and/or detachable joining and snapping arrangements.

Preferably, the type of connection between receptacles 12A and 12B as well as between receptacles 12B and 12C at respective joints J1 and J2 is essentially the type of connection between receptacle 12A and cap cover 18 as well as the type of connection between receptacle 12C and bottom cover 14. Consequently, receptacles of a general type can be provided, whereby receptacles 12A to 12C can be used interchangeably, while receptacle 12A is furnished with cap cover 18 and receptacle 12C is furnished with bottom cover 14 independently. Nevertheless, in some examples receptacle 12A is dedicated for or forming a part of cap cover 18, whereas receptacle 12C is dedicated for or forming a part of bottom cover 14.

Clearing mechanism 130 of disposal device 100 is characterized by concatenation of several longitudinal members 36A to 36C. Longitudinal members 36A to 36C are concatenated in tandem; so that the bottom of members 36A and 36B are respectively connected to the top of members 36B and 36C, at the corresponding joints J11 and J12. The types of connection between members 36A and 36B as well as between members 36B and 36C at respective joints J11 and J12 in a non-limiting manner include: screw threading, frictional and/or detachable joining and snapping arrangements.

Preferably, the type of connection between longitudinal members 36A to 36C as well as between members 36B and 36C at respective joints J11 and J12 is essentially the type of connection member 36C and lateral member 32. Consequently, longitudinal members of a general type can be provided, whereby members 36A to 36C can be used interchangeably, while member 36C is furnished with lateral member 32 independently. Nevertheless, in some examples longitudinal member 36C is dedicated for or forming a part of lateral member 32.

Figure 4:
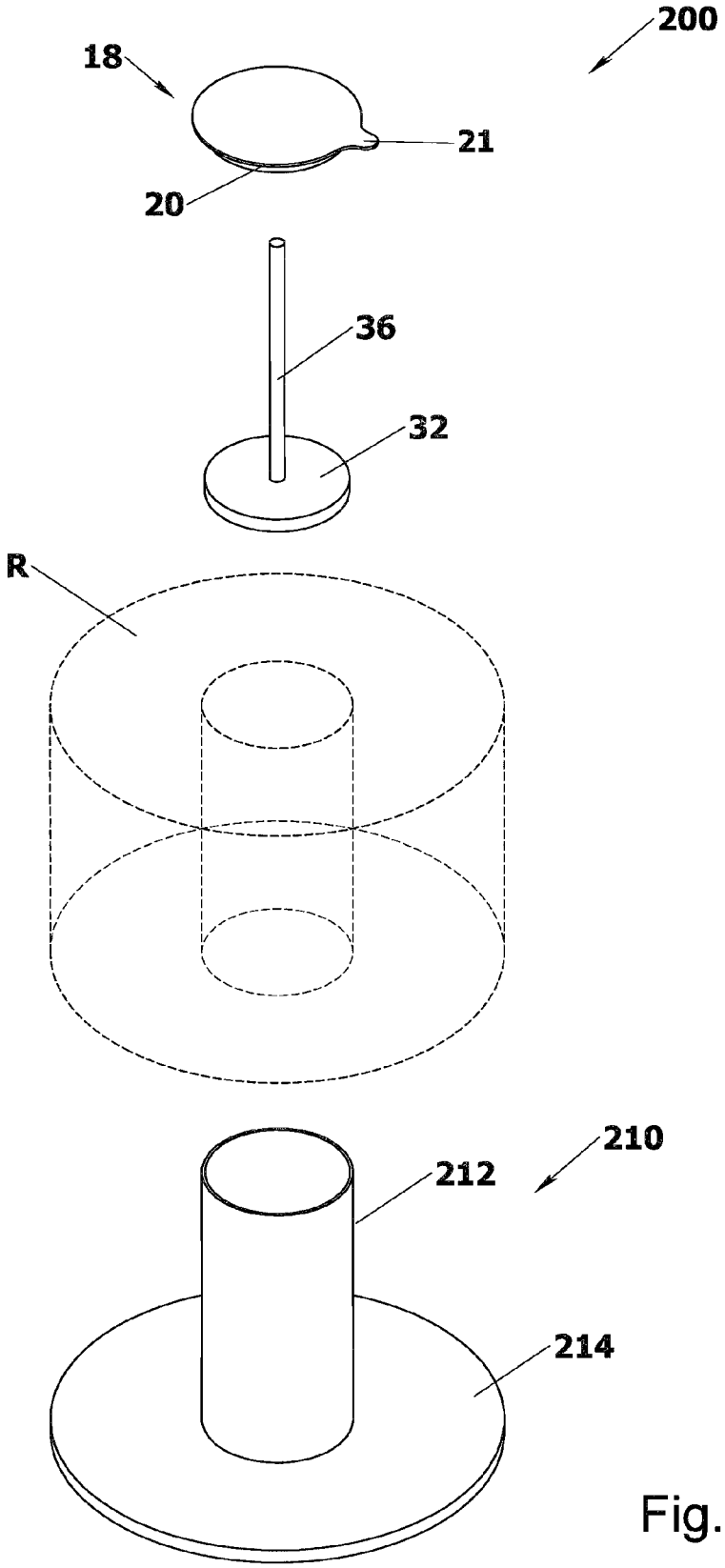
FIG. 4 is an isometric exploded view of yet another embodiment of the disposal device of the invention inserted, wherein the paper roll is shown in dashed lines.

In accordance with some embodiments of the invention, reference is now made for FIG. 4, showing insertable disposal device 200. Disposal device 200 is insertable into roll R, which is typically a toilet paper roll known in the art. Disposal device 200 comprises a cylindrical shell receptacle 212. Cylindrical shell receptacle 212 comprises pedestal 214. Pedestal 214 is either an integral portion of cylindrical shell receptacle 212 or an individual modular part (not shown), adapted to be reversibly mounted/removed onto/from the bottom portion of cylindrical shell receptacle 212.

Pedestal 214 is an essentially discoid plate. The exterior diameter of pedestal 214 is preferably somewhat corresponds to the exterior diameter of roll R, which is typically a toilet paper roll. Therefore upon introducing disposal device 200 into a paper roll, such as toilet paper roll R, pedestal 214 supports the entire roll R, including the outer portion thereof. Disposal device 200 comprises cap cover 18. Cap cover 18 is either permanently connected (not shown) to cylindrical shell receptacle 212 by a hinge or forms an individual modular part, adapted to be reversibly mounted/removed onto/from the top portion of receptacle 212; essentially as cap cover 18 of cylindrical shell receptacle 212.

The diameter of circumferential flange-shaped element 20 is typically somewhat larger than the diameter of the interior aperture in standard paper rolls known in the art, such as toilet paper rolls. Therefore upon introducing disposal device 200 into a paper roll, such as toilet paper roll R, flange-shaped element 20 acts as a mechanical stopper, preventing the introduction of cap cover 18 into a paper roll R beyond flange-shaped element 20.

Optionally the exterior surface of receptacle 212 is rather smooth and clear, sustaining a rotation of the paper roll, such as toilet paper roll R; thereby providing for unwinding the paper off toilet paper roll R while disposal device 200 is within the paper roll. No detent is typically provided to sustain a rotation of paper roll R on disposal device 200.

Disposal device 200 further comprises clearing mechanism 30 for removing the objects (not shown) from the interior lumen of receptacle 212. Clearing mechanism 30 comprises lateral member 32 and longitudinal member 36. Lateral member 32 and longitudinal member 36 are essentially the same as described hereinabove. In merely exemplary manner, lateral member 32 embodies a plate shape and longitudinal member 36 embodies a rod shape.

It will be appreciated by persons skilled in the art that the present invention is not limited by what has been particularly shown and described herein above. Rather the scope of the invention is defined by the claims which follow:

What is claimed is:

1. A disposal device insertable into a paper roll, said disposal device comprising:

(a) a cylindrical shell receptacle, said receptacle comprises:

(i) a cylindrical wall, said cylindrical wall defines an interior lumen of said receptacle that is adapted to receive disposal objects;

(ii) a bottom cover, said bottom cover comprises an exterior circumferential ridge extending outwardly from said cylindrical wall; wherein a diameter of said circumferential ridge is larger than a diameter of an interior aperture of said paper roll, whereby said circumferential ridge acts as a mechanical stopper;

(b) a cap cover, said cap cover comprises:

(i) an exterior circumferential ridge extending outwardly from said cap cover; wherein a diameter of said circumferential ridge is larger than said diameter of said interior aperture of said paper roll, whereby said circumferential ridge acts as a mechanical stopper;

(ii) at least one structural element adapted for purposefully opening said cover;

(c) a clearing mechanism adapted for removing said disposal objects from said interior lumen of said receptacle, said clearing mechanism comprises:

(i) a lateral member adapted to collect said disposal objects substantially across an entire cross-section of said receptacle;

(ii) a longitudinal member, said longitudinal member is implemented for at least conveying a physical force for translation of said lateral member;

said disposal device is characterized by that:

(d) said longitudinal member of said clearing mechanism assumes an empty conformation, while said receptacle is empty, and (e) said longitudinal member of said clearing mechanism assumes a filled conformation while said receptacle contains said disposal objects;

(f) said clearing mechanism is a pulling mechanism wherein said rod is disposed internally to said receptacle;

(g) wherein in said filled conformation, while said receptacle contains said disposal objects, said longitudinal member does not protrude from said disposal device (h) wherein said longitudinal member of said clearing mechanism in said filled conformation is displaced sidewise, towards said cylindrical wall of said receptacle.

2. The disposal device as set forth in claim 1, wherein said longitudinal member of said clearing mechanism in said empty conformation erects up-straight from said lateral member.

3. The disposal device as set forth in claim 1, wherein said bottom cover is an integral portion of said receptacle.

4. The disposal device as set forth in claim 1, wherein said cap cover is a separate entity, capable of being removed from the opening and then placed back onto the opening in order to reclose the top portion of said receptacle.

5. The disposal device as set forth in claim 1, wherein an exterior surface of said receptacle is furnished with a plurality of detents.

6. The disposal device as set forth in claim 1, wherein an exterior surface of said receptacle is furnished with a plurality of detents, wherein said detents prevent a unidirectional translation of said receptacle in said paper roll; thereby affixing said disposal device within said paper roll.

7. The disposal device as set forth in claim 1, wherein said lateral member embodies a shape selected from the group consisting of: a plate shape, baskets-like element, net and grating.

8. The disposal device as set forth in claim 1, wherein said longitudinal member embodies a rod-like shape, extending from the center of said lateral member.

9. The disposal device as set forth in claim 1, wherein said longitudinal member comprises an essentially firm and resilient material.

10. The disposal device as set forth in claim 1, wherein said disposal device is characterized by a plurality of said cylindrical shell receptacles longitudinally concatenated in tandem.

11. The disposal device as set forth in claim 1, wherein said clearing mechanism is characterized by a plurality of said longitudinal members concatenated in tandem.

12. The disposal device as set forth in claim 1, wherein said disposal device comprises a pedestal.

13. The disposal device as set forth in claim 1, wherein an exterior surface of said receptacle is adapted to sustain a rotation of said paper roll; thereby providing for unwinding a paper off said paper roll.

* * * * *